US007083503B2

(12) United States Patent
Sommer

(10) Patent No.: US 7,083,503 B2
(45) Date of Patent: Aug. 1, 2006

(54) METHOD FOR SHARPENING THE KNIFE OF A ROTARY TRIMMER AND A ROTARY TRIMMER FOR REALIZING THE METHOD

(75) Inventor: Remo Sommer, Oftringen (CH)

(73) Assignee: Muller Martini Holding AG, Hergiswil (CH)

( * ) Notice: Subject to any disclaimer, the term of this patent is extended or adjusted under 35 U.S.C. 154(b) by 138 days.

(21) Appl. No.: 10/927,187

(22) Filed: Aug. 27, 2004

(65) Prior Publication Data

US 2005/0048878 A1 Mar. 3, 2005

(30) Foreign Application Priority Data

Aug. 28, 2003 (EP) ..... 03405621

(51) Int. Cl.

| | |
|---|---|
| ***B24B 1/00*** | (2006.01) |
| ***B24B 7/19*** | (2006.01) |
| ***B24B 7/30*** | (2006.01) |
| ***B26D 7/08*** | (2006.01) |
| ***B21H 1/02*** | (2006.01) |

(52) U.S. Cl. ..... 451/45; 451/57; 451/58; 83/174; 76/87

(58) Field of Classification Search ..... 451/45, 451/57, 58, 234; 83/174, 174.1; 76/87, 76/89

See application file for complete search history.

(56) References Cited

U.S. PATENT DOCUMENTS

| | | | | |
|---|---|---|---|---|
| 5,709,255 | A * | 1/1998 | Toogood | 144/220 |
| 5,941,148 | A * | 8/1999 | Miller et al. | 83/174 |
| 6,616,515 | B1 * | 9/2003 | Dwyer | 451/65 |
| 6,634,257 | B1 * | 10/2003 | Long et al. | 76/86 |
| 6,692,424 | B1 * | 2/2004 | Pasman et al. | 493/324 |
| 6,748,836 | B1 * | 6/2004 | Vivirito et al. | 83/174 |
| 6,752,052 | B1 * | 6/2004 | Bowlin | 82/1.11 |

FOREIGN PATENT DOCUMENTS

| | | |
|---|---|---|
| DE | 101 35 177 A1 | 2/2003 |
| EP | 0 450 338 A1 | 10/1991 |
| WO | WO 00/69596 A1 | 11/2000 |

* cited by examiner

*Primary Examiner*—Lee D. Wilson
*Assistant Examiner*—Alvin J. Grant
(74) *Attorney, Agent, or Firm*—Venable LLP; Robert Kinberg

(57) ABSTRACT

A rotary trimmer includes a first trimming element having a first knife and a second trimming element having a second knife that operates jointly with the first knife. In order to sharpen one knife, the other knife is removed and is replaced with a sharpening disk. The sharpening disk or the knife to be sharpened is advanced during a sharpening operation.

12 Claims, 2 Drawing Sheets

METHOD FOR SHARPENING THE KNIFE OF A ROTARY TRIMMER AND A ROTARY TRIMMER FOR REALIZING THE METHOD

CROSS-REFERENCE TO RELATED APPLICATION

This application claims the priority of European Patent Application No. 03405621.8, filed on Aug. 28, 2003, the subject matter of which is incorporated herein by reference.

BACKGROUND OF THE INVENTION

The invention relates to a method of sharpening a rotary trimmer knife in the print-processing industry, wherein a first knife with a first bearing forms a first trimming element and, for the trimming operation, operates jointly with a second knife which together with a second bearing forms a second trimming element.

Rotary trimmers are used in particular in the print-processing industry for trimming the open sides of printed products, for example magazines. As a rule, the printed products are conveyed between two belts in a shingled flow and are trimmed during the flow-through operation. The rotary trimmer is provided with an upper knife and a lower knife, also called a counter knife. The shingled flow is trimmed between these two knives, in a manner known per se.

With the rotary trimmer of the assignee of the present application, the upper knife comprises a steel knife holder with hard-metal blades clamped thereto while the lower knife and/or counter knife consists of a steel knife holder onto which a hard metal ring is glued. For an optimum trimming, the gap between upper and lower knife should be, for example, in a range of 0.03 to 0.035 mm. A precision angular ball bearing arrangement can form the bearings for the two knife shafts. An adjusting spindle with vernier is used for adjustment of the lower knife, for which either a bushing or a slide is displaced along a dovetail guide.

As a rule, the upper knife is sharpened when the trimming quality diminishes. The lower knife experiences little wear because of its geometry. Until now, the following two methods have generally been used for sharpening the upper knife:

According to the first method, the complete trimming element is pulled out of the rotary trimmer for the sharpening and is replaced with a trimming element having sharpened blades. The removed trimming element and the replacement trimming element respectively are provided with a knife and ball bearing. The removed trimming element is installed in an external sharpening device where the upper knife is sharpened. The trimming element with the sharpened upper knife is subsequently reinstalled in the rotary trimmer, whereupon the trimming gap must be readjusted. The advantage of this method is a comparably short stop period for the machine and that the geometries between upper knife and lower knife are retained since all components remain inside the trimming element. However, this method has the disadvantage that the user of the rotary trimmer must purchase expensive replacement trimming elements.

According to the second method, the upper knife only is removed from the rotary trimmer and replaced with an already sharpened upper knife, whereupon the trimming gap is adjusted again and production can resume. The upper knife to be sharpened is then sharpened separately in a sharpening unit or at a non-affiliated company. The advantage of this method is that the client must purchase only replacement upper knives and not a complete replacement trimming element. The disadvantage is a longer stop period of, for example, 10 to 30 minutes since the trimming gap must be re-adjusted following the replacement of the knives. In addition, inaccuracies during the sharpening operation must be corrected with this method through increasing the trimming gap adjustments, wherein these inaccuracies in particular relate to axial run-out deviation and parallelism.

SUMMARY OF THE INVENTION

It is an object of the present invention to develop a method of the aforementioned type which permits an easier sharpening, in particular of the upper knife, at a lower cost while still maintaining a high trimming quality.

The above and other objects are accomplished according to the invention by the provision of a method for sharpening a knife on a rotary trimmer in the print-processing industry, wherein the rotary trimmer includes a first trimming element having a first knife and a second trimming element having a second knife which operates jointly with the first knife, the method comprising: removing and replacing one of the first and second knives with a sharpening disk for sharpening the other of the first and second knives; and advancing one of the sharpening disk and the other of the first and second knives during a sharpening operation.

Measurements have shown that with the method using an external sharpening unit for sharpening the upper knife, an axial run-out deviation of 0.01 mm results following the re-installation into the rotary trimmer.

In contrast, no axial run-out deviation error could be measured following the sharpening of the upper knife with the method according to the invention. Thus, the trimming gap adjustment can be narrower by 0.01 mm with a knife that is sharpened according to the invention, which corresponds to a reduction by 30%. This effect could not be predicted and is therefore quite surprising.

The method according to the invention is particularly suitable for sharpening the upper knife. However, the lower knife and/or counter knife can also be sharpened in principle by replacing the upper knife with a sharpening disk.

The method is particularly suitable for sharpening an upper knife designed as a segment knife, meaning the knife has a plurality of blades mounted on a holder. Segmented upper knives of this type are in principle sharpened dry. Since the blades are interrupted because of the segmenting and the area to be sharpened is relatively small, no critical heating up occurs and no cooling is therefore necessary during the sharpening operation. In principle, a wet sharpening is also possible with the method according to the invention. Of course, a dry sharpening is much simpler since no cooling agent must be supplied.

According to one modified version of this method, the sharpening disk is connected via an endless drive element to the knife to be sharpened, wherein the sharpening disk as well as the knife to be sharpened must be provided with a pulley, in particular with a belt pulley. The belt pulleys are designed such that they ensure a suitable translation as well as an optimum sharpening speed. For hard metal, an optimum sharpening speed of 20 to 25 m/s can be achieved. A flexible flat belt, in particular, is suitable for use as the drive element. A protective cover can be installed easily to ensure the safety or as a protection against dust. Flying sparks are not expected as a result of the small degree of advancement.

The invention relates furthermore to a rotary trimmer for realizing this method.

Additional advantageous features follow from the following description when considered in conjunction with the drawings.

BRIEF DESCRIPTION OF THE DRAWINGS

The method according to the invention is explained in further detail in the following with the aid of the drawings.

DETAILED DESCRIPTION OF THE INVENTION

Figure 1:
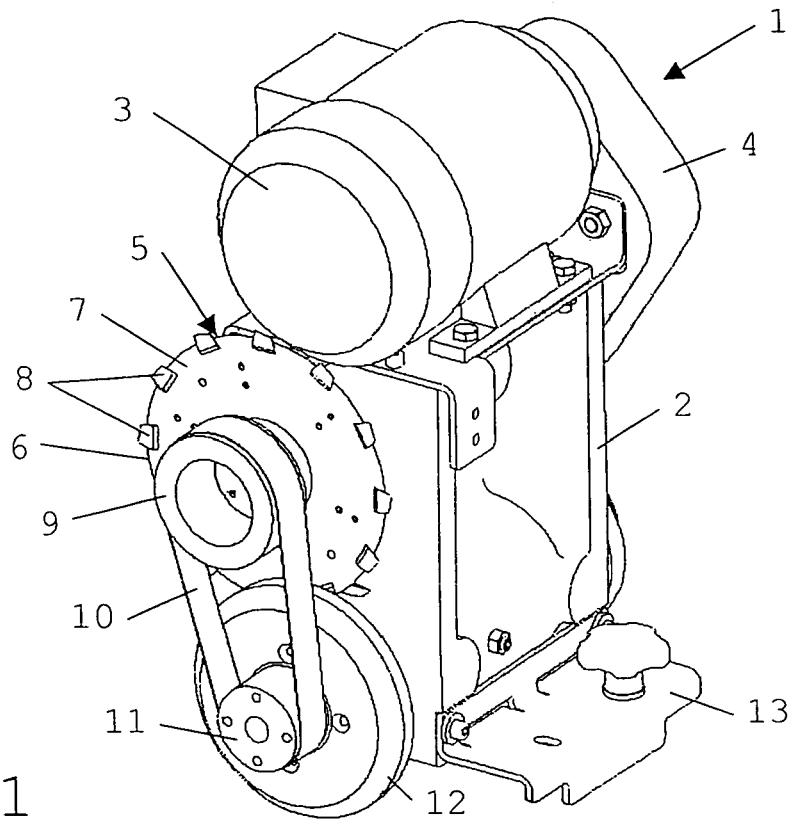
FIG. 1 is a three-dimensional view of a rotary trimmer according to the invention for which the lower knife has been replaced with a sharpening disk.
Figure 2:
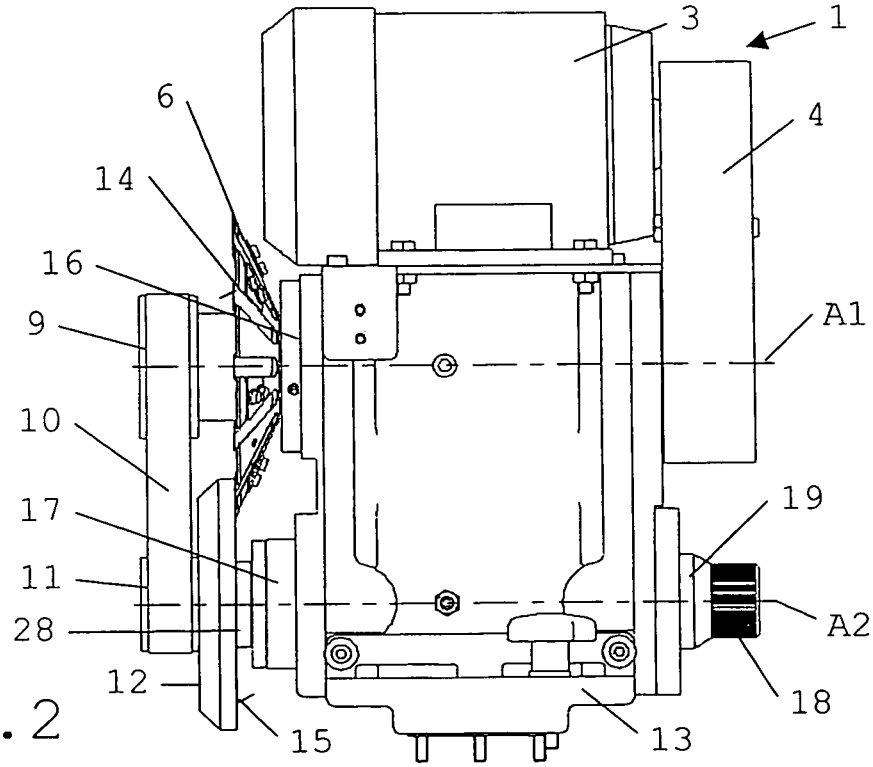
FIG. 2 is a front view of the rotary trimmer according to FIG. 1.

The rotary trimmer 1, shown in FIGS. 1 and 2, comprises a machine frame 2 with therein disposed trimming element 5 that is provided with an upper knife 6. The trimming element 5 has a shaft, not shown herein, driven by a motor 3 which is mounted on the machine frame 2. A drive element, also not shown herein, is arranged below a cover 4 and connects the motor to the shaft of the trimming element 5. The lower end of the machine frame 2 is provided with a fastening plate 13 for a suitable positioning of the rotary trimmer 1 next to a shingled flow and/or a conveying device for such a shingled flow.

The upper knife 6 is a so-called segmented knife and is provided with a disk-shaped holder 7, having a plurality of hard metal blades 8 clamped on along the circumference. A person skilled in the art will be familiar with upper knives 6 of this type.

The trimming element 5 is provided with a bearing 16, which is only indicated in FIG. 2, in the form of a precision angular ball bearing. FIG. 2 shows the axis A1 for this bearing 16.

Figure 3:
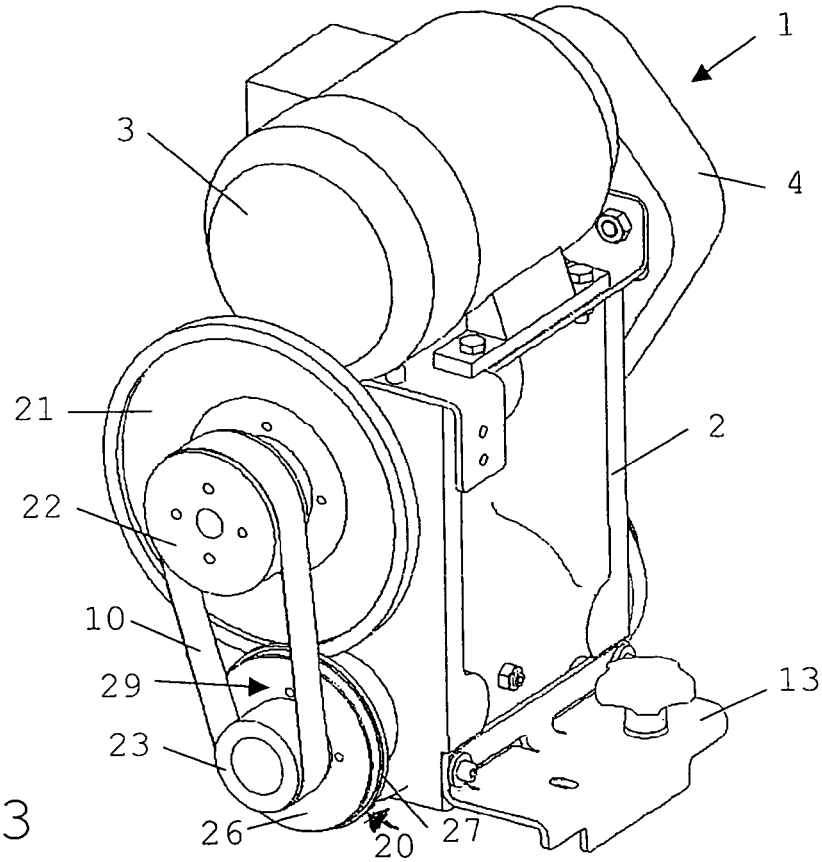
FIG. 3 is a three-dimensional view of a rotary trimmer according to the invention for which the upper knife has been replaced with a sharpening disk.
Figure 4:
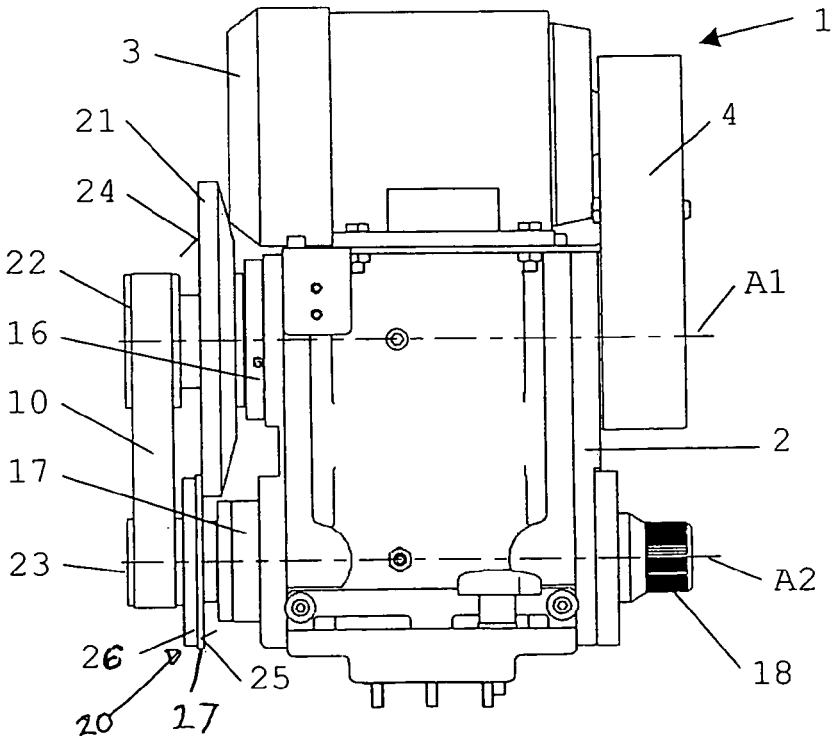
FIG. 4 is a front view of the rotary trimmer according to FIG. 3.

A belt pulley 9 is mounted on the upper knife 6 and is arranged coaxial to the axis A1. A drive belt 10 is fitted around this belt pulley 9, as well as around another belt pulley 11 on a sharpening disk 12. The sharpening disk 12 is mounted on a holder 28, which normally holds the lower knife 20 of a different trimming element 29, as shown in FIG. 3. This holder 28 is connected to a shaft, not shown herein, which is positioned on a bearing 17 that is indicated in FIG. 4. The axis A2 for this shaft extends parallel to the axis A1. The holder 28 can be adjusted in the directions of axis A2 with the aid of a rotary knob 18, provided with a vernier, of an advancing device 19. The adjustment occurs in a manner known per se, in particular with the aid of an adjusting spindle. A bushing or slide is displaced for this along a dovetail guide, thus permitting an extremely precise advancement of the sharpening disk 12 along the axis A2.

According to FIG. 2, the sharpening disk 12 has a flat inside surface 15, the upper region of which can be fitted against the lower region of an inside 14 of the upper knife 6. If the upper knife 6 is rotated with the aid of motor 3 around the axis A1, then the sharpening disk 12 simultaneously rotates around the axis A2 since the drive belt 10 connects the upper knife 6 to the sharpening disk 12. The sharpening disk 12 rotates considerably faster then the upper knife 6 since the diameter of belt pulley 11 is considerably smaller than that of belt pulley 9.

The transmission ratio is selected to result in an optimum sharpening speed which is in the range of 20 to 25 m/s for the hard metal blades 8.

The method for sharpening the upper knife 6 is explained in further detail in the following.

For the sharpening of upper knife 6, the lower knife 20 is removed from the holder 28 and the sharpening disk 12 fitted onto the holder 28 and connected to this holder, so as to rotate along. For this, the belt pulley 11 is already mounted on the sharpening disk 12. The belt pulley 9 is then installed on the upper knife 6 and the drive belt 10 is fitted around the two belt pulleys 9 and 11. For safety reasons, a protective cover that is not shown herein is also installed, which covers in particular the upper knife 6. The motor 3 is subsequently connected for operating the upper knife 6 and the sharpening disk 12. Based on the aforementioned translation ratio, the relative rotational speed corresponds to the optimum sharpening speed.

The sharpening disk 12 is subsequently advanced with the aid of rotary knob 18 until the inside surface 15 of the sharpening disk 12 fits against the surfaces of the blades 8. The sharpening time depends on the amount of wear of the blades 8. With each sharpening operation, for example, the sharpening disk 12 is advanced about 1/100 mm and the subsequent sharpening operation lasts approximately one minute. This operation is repeated until all blades 8 exhibit the required quality. Following the last forward movement, for example, a 10-minute final sharpening must take place.

Once the sharpening of the upper knife 6 is completed, the sharpening disk 12 is again replaced with the lower knife 20. The drive belt 10 and the two belt pulleys 9 and 11 are removed for this operation. Following the adjustment of the trimming gap, the rotary trimmer 1 is again ready for production.

The aforementioned sharpening operation can be dry since the blades are interrupted due to segmenting and no critical heating up occurs. A wet sharpening is possible in principle with the aid of a suitable cooling fluid, provided the upper knife 6 is not a segmented knife of this type. As explained in the above, the sharpening occurs with high precision since the high precision of the trimming element bearings that provides for an adjustment without play is also utilized for the sharpening. An optimally small adjustment of the trimming gap is thus possible even after the sharpening, which permits excellent trimming results.

The method can also be used for sharpening the lower knife 20. In that case, the upper knife 6 is replaced by the sharpening disk 21 shown in FIGS. 3 and 4. For the re-sharpening, the sharpening disk 21 is accordingly driven directly by the motor 3. A belt pulley 23 which is connected via the drive belt 10 to the belt pulley 22 is fitted onto the lower knife 20. The translation ratio is again selected such that an optimum trimming speed results. The lower knife 20 to be sharpened comprises a holder 26 onto which a hard metal ring 27 is glued. According to FIG. 4, this ring 27 has an inside surface 25 against which a flat inside surface 24 of the sharpening disk 21 is fitted during the re-sharpening operation. For the sharpening operation, the lower knife 20 is advanced by turning the rotary knob 18. For the above-stated reasons, an extremely precise sharpening operation that permits excellent trimming results is possible in this case as well. Once the sharpening of the lower knife 20 is finished, the sharpening disk 21 is removed and is again replaced with the upper knife 6. Of course, the belt 10 and the two belt pulleys 22 and 23 are removed as well. The motor 3 functions as the drive for sharpening the upper knife 6 as well as the lower knife 20. However, it is also possible in principle to use an additional motor for driving the sharpening disk 12 or the lower knife 20.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. A method for sharpening a knife on a rotary trimmer in the print-processing industry, wherein the rotary trimmer includes a first trimming element having a first knife and a second trimming element having a second knife which operates jointly with the first knife, the method comprising:

removing and replacing one of the first and second knives with a sharpening disk for sharpening the other of the first and second knives; and advancing one of the sharpening disk and the other of the first and second knives during a sharpening operation.

2. The method according to claim 1, including connecting the sharpening disk and the other of the first and second knives to a drive element and driving the both the sharpening disk and the other of the first and second knives by the drive element.

3. The method according to claim 1, including individually driving the sharpening disk and the other of the first and second knifes.

4. The method according to claim 1, wherein the second trimming element includes a bearing coupled to the second knife and having an adjustment mechanism for adjusting a trimming gap between the first and second knives, and the method further includes using the adjustment mechanism for advancing the sharpening disk or the knife to be sharpened.

5. The method according to claim 1, including providing the first knife in the form of a segmented knife comprising several blades disposed along a circumference of a holder for the first knife.

6. The method according to claim 5, including providing the first knife above the second knife.

7. The method according to claim 6, including dry sharpening the first knife.

8. The method according to claim 6, wherein the removing and replacing step includes removing and replacing the second knife with the sharpening disk and the advancing step includes advancing one of the sharpening disk and the first knife during the sharpening operation.

9. The method according to claim 8, including using a vernier for the advancing step.

10. A rotary trimmer for implementing the method according to claim 1, comprising:

a sharpening disk including trimming surface;

a first trimming element including a first knife and a holder removably holding the first knife; and a second trimming element including a second knife and a holder removably holding the second knife, wherein following a removal of the first and/or second knife, the sharpening disk can be fitted onto the holder of the respective knife so that the trimming surface is fitted against and/or moved toward a side of the knife to be sharpened.

11. The rotary trimmer according to claim 10, further including a first drive element installed on the sharpening disk; a second drive element installed on the knife to be sharpened; and a further drive element connecting the first and second drive elements.

12. The rotary trimmer according to claim 11, wherein the first and second drive elements are pulleys and the further drive element is a pulley belt.

* * * * *